US008453392B1

(12) United States Patent
Hurst

(10) Patent No.: US 8,453,392 B1
(45) Date of Patent: Jun. 4, 2013

(54) SYSTEM FOR POSITIONING AND HOLDING CEILING PANELS

(75) Inventor: Ralph G. Hurst, Tehachapi, CA (US)

(73) Assignee: Ralph G. Hurst, Tehachapi, CA (US)

( * ) Notice: Subject to any disclaimer, the term of this patent is extended or adjusted under 35 U.S.C. 154(b) by 0 days.

(21) Appl. No.: 13/385,523

(22) Filed: Feb. 22, 2012

Related U.S. Application Data

(60) Provisional application No. 61/463,943, filed on Feb. 25, 2011.

(51) Int. Cl.
*E04G 21/16* (2006.01)

(52) U.S. Cl.
USPC ..... 52/127.2; 52/749.1

(58) Field of Classification Search
USPC ..... 52/127.2, 749.1; 414/10; 269/3, 269/6, 95; 29/244, 255, 270, 278; 248/544
See application file for complete search history.

(56) References Cited

U.S. PATENT DOCUMENTS 2,602,634 A * 7/1952 Read ..... 254/131
3,910,421 A * 10/1975 Panneton ..... 414/11
4,695,028 A * 9/1987 Hunter ..... 248/354.1
5,274,978 A * 1/1994 Perkonigg et al. ..... 52/547
5,655,337 A * 8/1997 Bryant et al. ..... 52/127.2
5,979,887 A * 11/1999 Hassman ..... 269/40
6,244,810 B1 * 6/2001 Reyes ..... 414/11
6,467,236 B1 * 10/2002 Schlegel ..... 52/749.1
6,904,732 B1 * 6/2005 Richmond ..... 52/749.1
2001/0029715 A1 * 10/2001 Bradley et al. ..... 52/344
2004/0182019 A1 * 9/2004 Flynn ..... 52/127.2
2008/0258028 A1 * 10/2008 Garcia et al. ..... 248/221.11
2012/0222386 A1 * 9/2012 Matthews ..... 52/749.1

* cited by examiner

*Primary Examiner* — Darnell Jayne
*Assistant Examiner* — Sasha T Varghese

(57) ABSTRACT

An overhead panel installation system consisting of three components that hold drywall or other panels onto ceiling joists thereby allowing workers to place the panels and let go while they nail or screw the panels to the joists. Component "A" is placed over two top plates of a wall whereby a bent portion of component "A" extends away from the wall and creates a first ledge for a first panel to be held in place. Component "B" is subsequently placed over the end of the secured first panel opposite the wall and creates a second ledge for a second panel to be placed and held. Lastly, component "C" is fitted under a ceiling joist, turned, and locked in place to create a third ledge to further support the second panel. Each of the three components can be simply removed with a twist of the handle.

4 Claims, 6 Drawing Sheets

SYSTEM FOR POSITIONING AND HOLDING CEILING PANELS

This application encompasses and incorporates by reference the claims, descriptions and explanations already contained in a provisional patent of this device, application 61/463,943, filed on Feb. 25, 2011.

FIELD OF THE INVENTION

This invention pertains to the field of building construction, more particularly to tools and devices designed to temporarily hold drywall/panel, plywood, OSB, or other construction stock in place while installing these panels overhead.

BACKGROUND OF THE INVENTION

This invention relates to systems and methods for positioning and holding the drywall/panel to the ceiling for nailing in buildings and other structures the new system and method simplifies the types of elements used and to be installed for positioning drywall/panel in any structure. The invention allows for supporting the drywall/panel in a fashion that allows for the installers hands to be free once the tool is installed. Once the sheet of drywall/panel is fastened, the main part of the tool is then pivoted to be released from the overhead lumber material, and the additional component selected for the particular application is also removed, leaving the drywall/panel sheet safely attached in place.

For ceilings of any height (normally 8 feet minimum), the material must be elevated and positioned to be nailed or screwed. The general practice has been for two installers to climb up steep ladders holding the sheet with both hands and on their head to position. This common practice can be a tedious, time-consuming, and dangerous operation, which can easily result in injury due to falling while attempting to support the heavy drywall/panel overhead panel.

Other devices such as long "T" supports from the floor to the ceiling material to place a nail is also an awkward practice, tediously balancing the material on makeshift "stilts" while rushing to install screws. Such devices are cumbersome and large, and support the drywall/panel panel from the floor.

SUMMARY OF THE INVENTION

The present invention is directed to systems and methods for positioning and holding drywall/panel boards up to ceiling joists in wood construction this system, known as Easy Up Drywall/panel, consists of three components hereby known as component "A," component "s," and components "C."

Component "A" consists of a steel rod 3/16 inch in diameter. This rod extends 1 inch horizontally then bends down vertically for 1 inch then bends again horizontally for 1 inch then bends around 180° for 1 inch then again bends down vertically for one and ¾ inch then bends again horizontally to be parallel with the upper rod for 1 inch. This bend goes through a 3/16 inch hole through a ½ inch steel pipe then bends again in a 180° and back through a second 3/16 inch hole in said pipe. This pipe can vary in length and creates a handle for component "A" tool Component "B" consists of a steel rod ⅛ inch in diameter. This rod extends 1 inch horizontally then bends down vertically for three-quarter inch then bends back horizontally for 1 inches passing through a ½ inch steel pipe. It then bends a 180° once again passing through the ½ inch pipe horizontally for 2 inches. This steel pipe creates a handle for component "B."

Component "C" consists of a 3/16"×1"×4.5" flat steel bar bent in a "U" shape with an inside width of 1½ inch to slip under a two by (2") ceiling joist. Welded to the side of this bar is a three-quarter inch by 2⅜ inch pipe in which a 0.625"×20" steel rod with a top portion bent 90° horizontally for three-quarter inch is placed through the 2⅜ inch pipe. The end portion of this horizontal member is ground top and bottom to form a point capable of cutting into the side of the wood joist approximately 3/16 inch deep. The bottom end of this ⅝ inch rod has a 0.5"×8" pipe handle horizontally welded to the side of this ⅝ inch rod. Immediately under the 2⅜ inch pipe is a 3/16 inch by three-quarter inch by 6 inch flat steel bar to create a ledge to support the drywall/panel board.

These and other features and aspects and advantages of the present invention will become better understood with reference to the following drawings and descriptions and claims.

DETAILED DESCRIPTION

Figure 1:
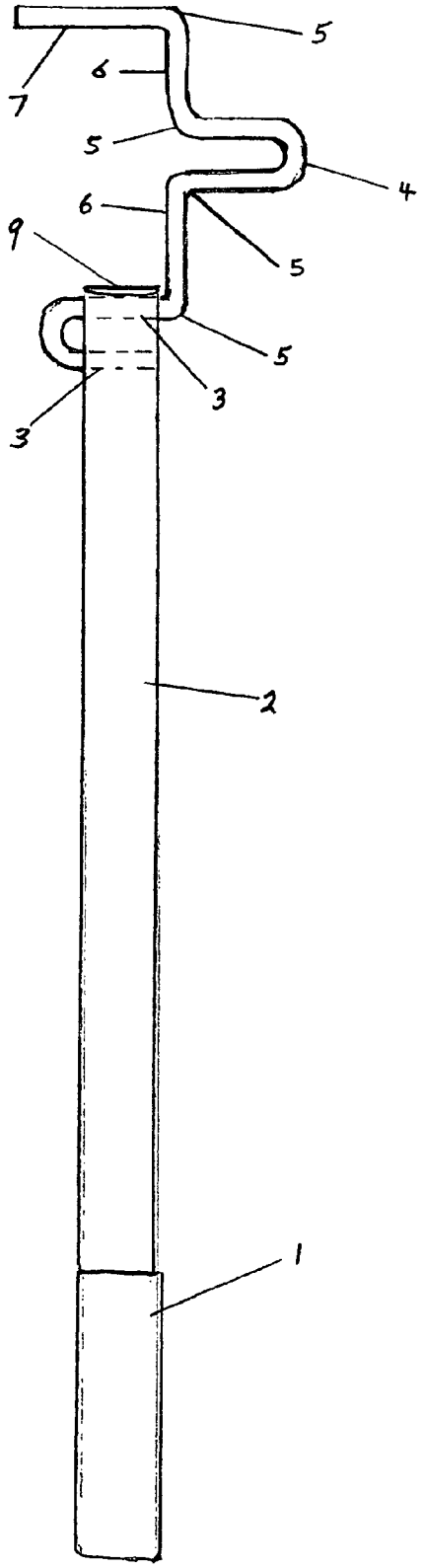
FIG. 1 illustrates a perspective view of a positioning system on a sidewall according to an embodiment of the invention.

The following detailed description represents the best currently contemplated models for carrying out the invention the description is not to be taken in a limiting sense but is made merely for the purpose of illustrating the general principles of the invention Referring to FIG. 1 component "A," positioning system for drywall/panel boards consists of a 3/16 inch steel rod horizontal for 1 inch (7) then bends 90° (5) vertical for 1 inch (6) then bends 90° (5) again for 1 inch then bends 180° for 1 inch then again bends 90° (5) vertical for 1½ inch (6) then again bends in 90° (5) horizontal for 1 inch passing through a 3/16 inch hole (3) through a steel pipe handle to then again bend 180° again through a lower 3/16 inch hole (3) through the pipe handle.

Figure 5:
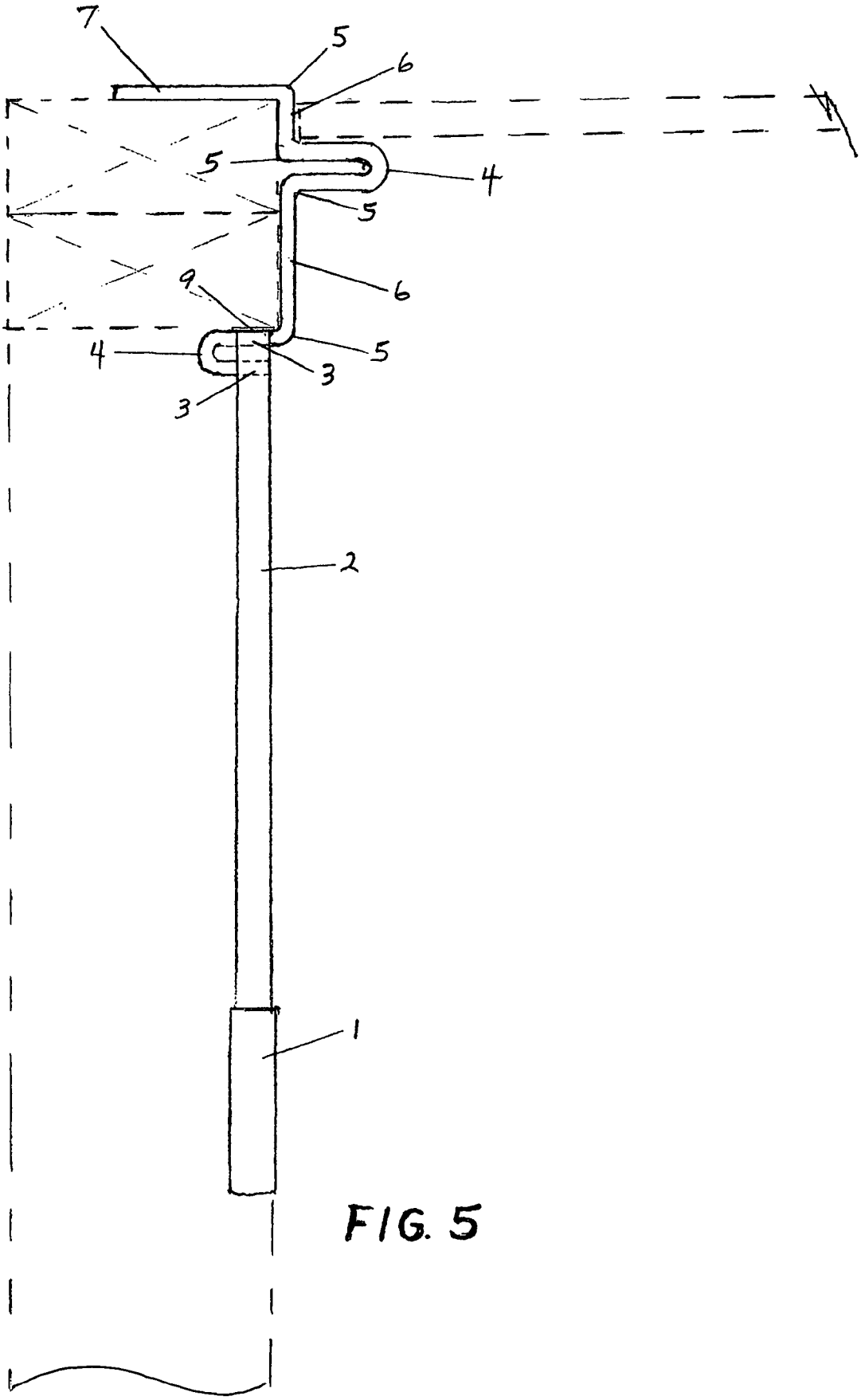
FIG. 5 illustrates a side elevation view of a positioning system and how it attaches and completes its task.

This component is placed over double "two-by" (nominal 2" framing lumber) wood framing members known as top plates the top horizontal members (7) slips over the top two-by wood member and the top of the steel pipe handle slips under the bottom two-by framing member. The 180° portion (4) of the steel rod creates a ledge in which the ceiling drywall/panel can rest allowing the installer to release that side of the drywall/panel see FIG. 5.

Figure 2:
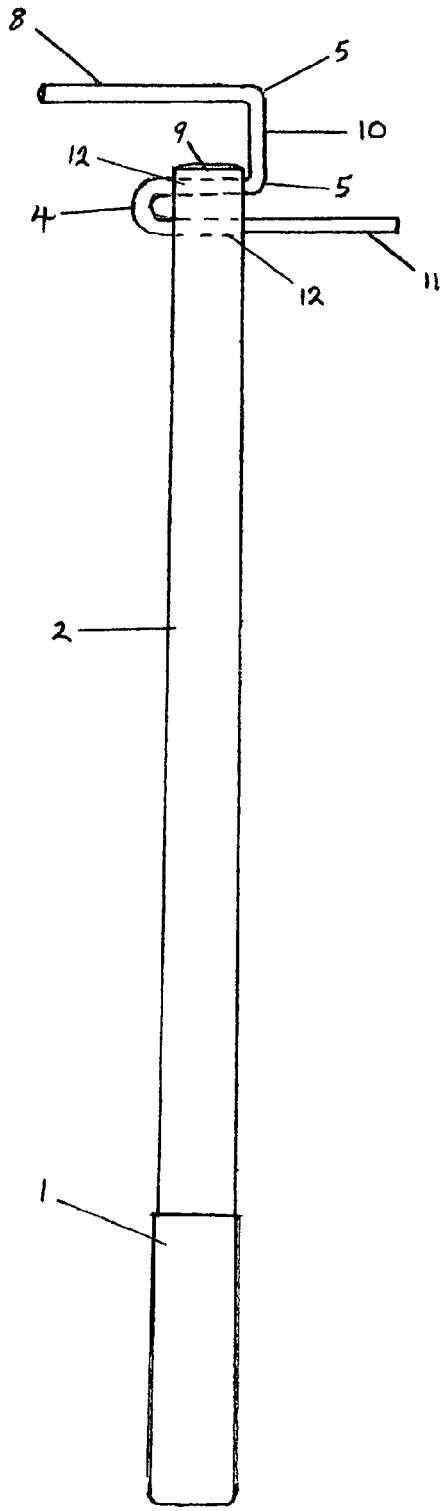
FIG. 2 illustrates a side elevation view of a positioning system element according to an embodiment of the invention.
Figure 6:
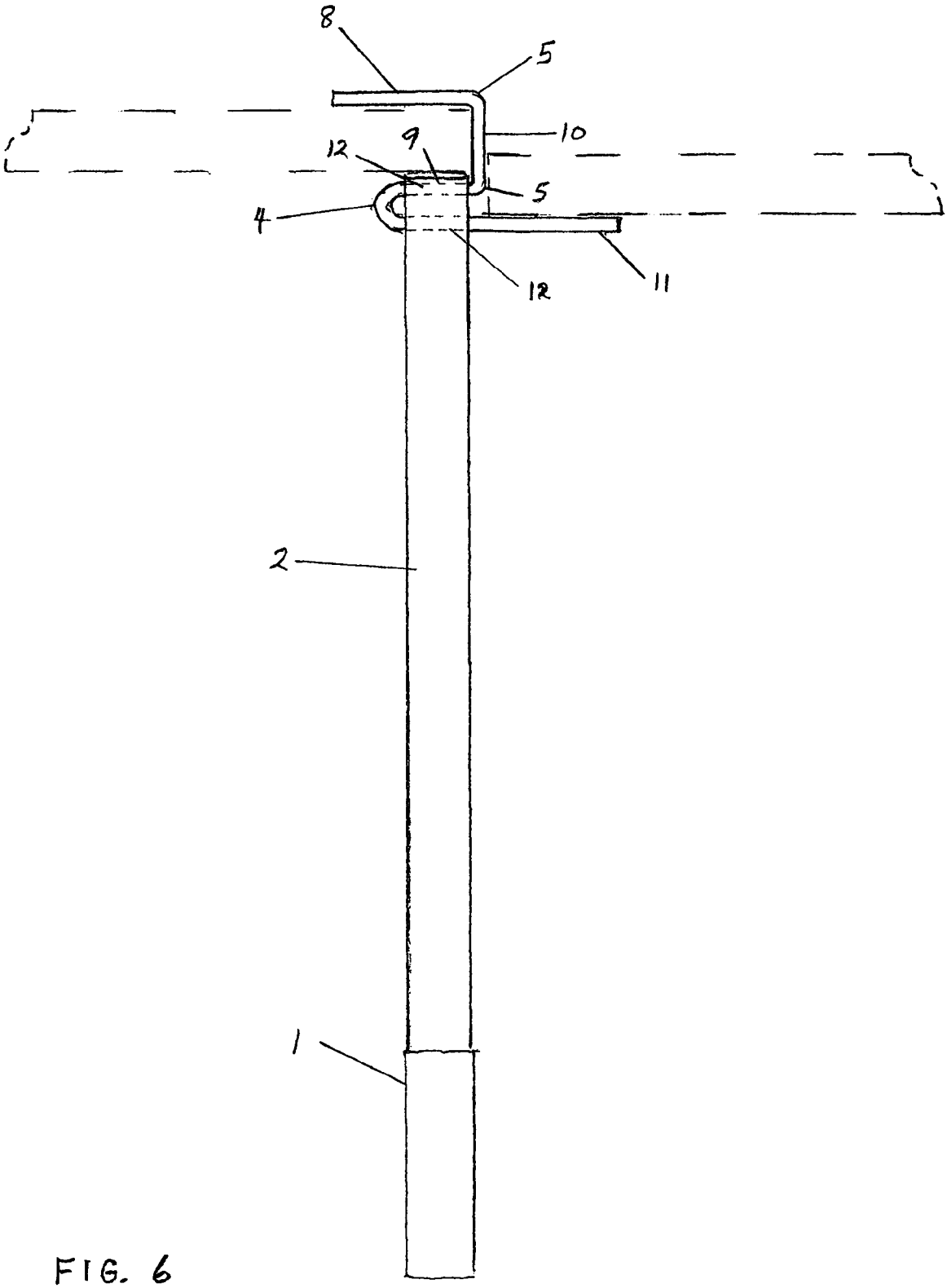
FIG. 6 illustrates a side elevation view of a positioning system and how it attaches and completes its task.

Referring to FIG. 2 component be a positioning system for drywall/panel board consists of a ⅛ inch steel rod horizontal for 1 inch (8) then bends 90° for three-quarter inch vertical 10 then again 90° (5) for three-quarter inch horizontal passing through a ⅛ inch hole (12) through a steel pipe handle to then turns 180° and back through a lower ⅛ inch hole (12) for 1½ inch (11) the top horizontal member (8) slips over the ceiling drywall/panel board that is already nailed to the top portion (9) of the pipe handle two slides under the bottom of the nailed drywall/panel this creates a ledge (11) to place the next sheet of drywall/panel. (see FIG. 6)

Figure 3:
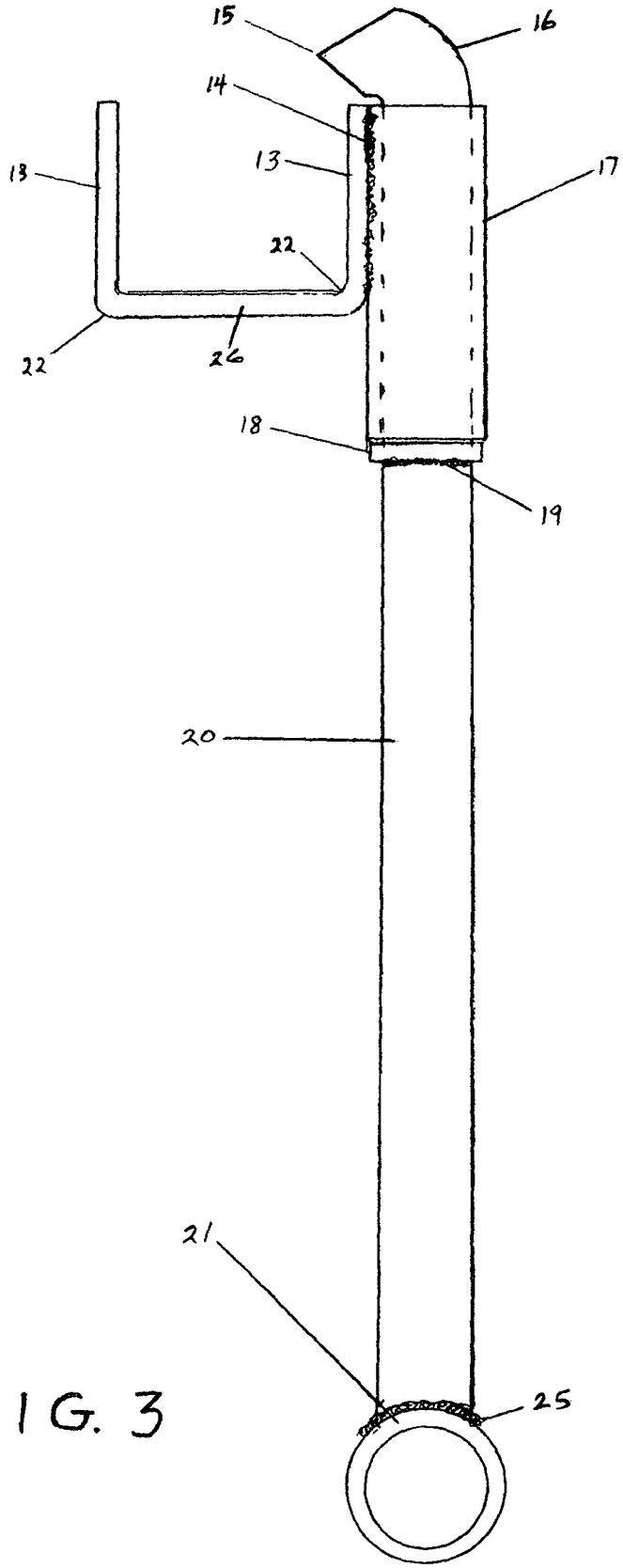
FIG. 3 illustrates a side elevation view of a positioning system element according to an embodiment of the invention.
Figure 4:
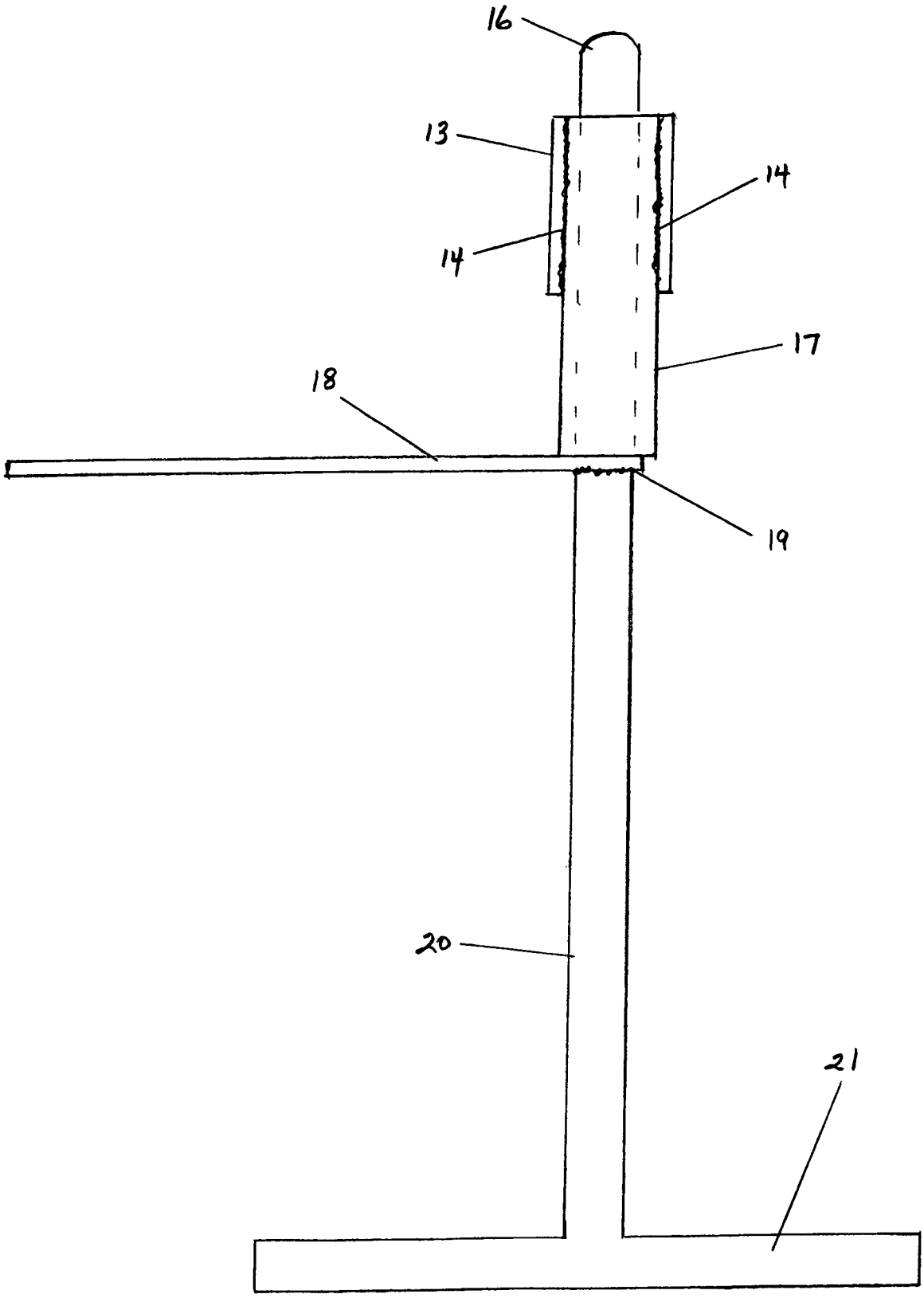
FIG. 4 illustrates a front elevation view of a positioning system element according to an embodiment of the invention.

Referring to FIG. 3 component "C," a positioning system for drywall/panel boards consists of a 3/16"×1" steel bar 1½ inch vertical (13) then bends 90° (22) core optimally for one and a half inch (26) then 90° upwards (22) for ½ inch (13) this 1 inch flat steel bar (13) is welded (14) to 0.5"×2.375" steel pipe (17) a ⅝ inch steel rod (20) with a top portion bent 90° horizontally for three-quarter inch (16) is placed through the pipe (17) the end of this bent portion is ground to a point (15) approximately 1/16 inch at the bottom of the pipe (17) the ⅝ inch steel rod (20) has a 3/16 inch by three-quarter inch by 6 inch steel bar (18) welded (19) to the ⅝ inch rod (20) creating an outward arm to place the ceiling drywall/panel (see FIG. 7) at the very bottom of the 518 inch rod (20) is a steel pipe 8 inches long (21) is welded (25) to create a handle (21).

Figure 7:
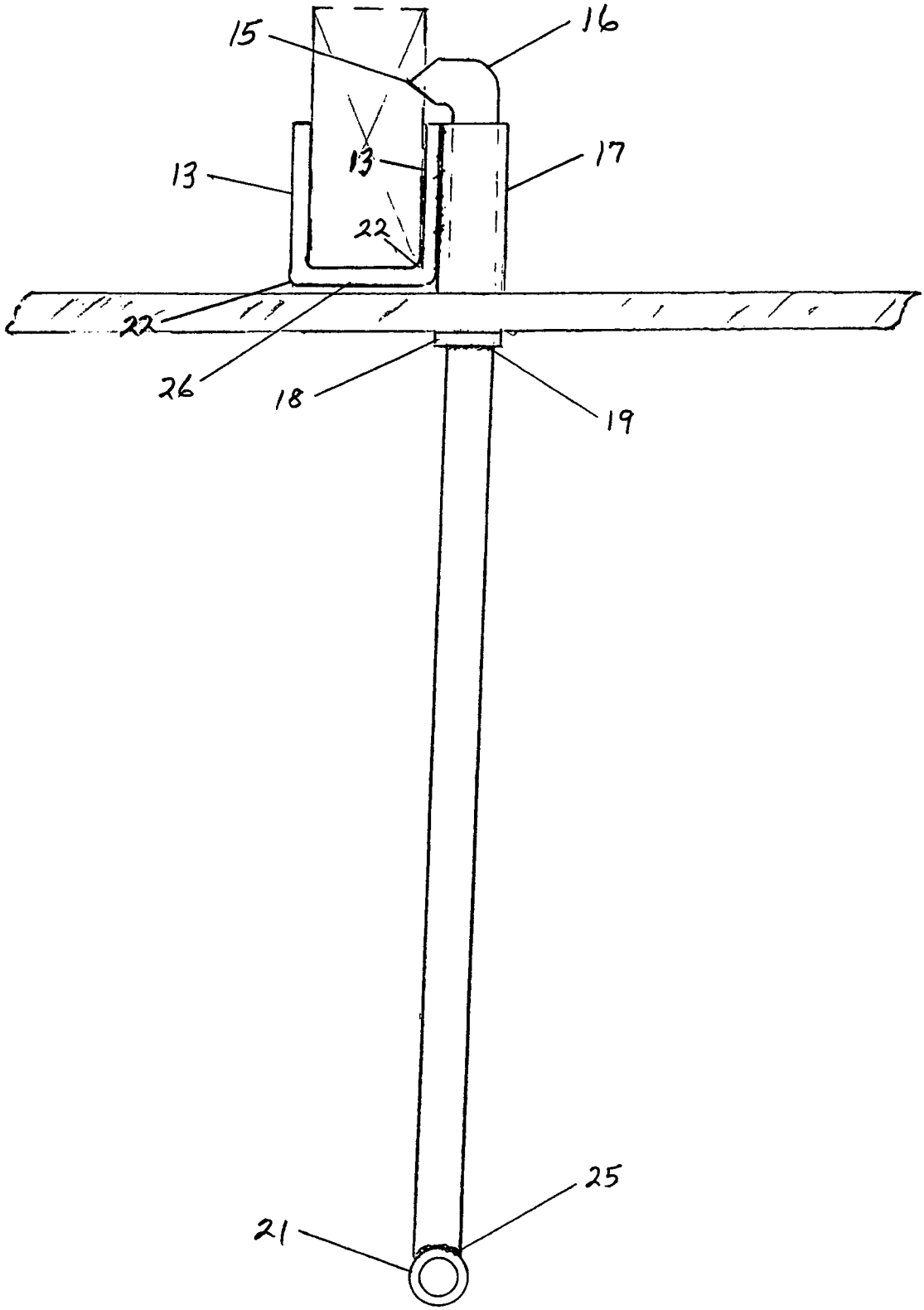
FIG. 7 illustrates a side elevation view of a positioning system and how it attaches and completes its task.

When the U-shaped portion of components "C" (15) (26) (13) is pushed up to the underside of a 2×4 ceiling joist that handle (21) can then be turned 90° causing the tip (15) to dig tightly into the side of the ceiling joist leaving the arm (18) in an outward position and creating a 6 inch ledge to place a ceiling drywall/panel the installer can now let go and nail or screw the drywall/panel to the ceiling joists (see FIG. 7)

When the invention has been particularly shown and described with respect to the illustrated embodiments thereof it will be understood by those skilled in the art that the foregoing and other changes in form and details may be made therein without departing from the spirit and scope of the invention.

The invention claimed is:

1. An overhead panel installation system comprising:

a) a first component comprising a steel pipe handle with first and second apertures and a steel rod which from a terminal end thereof extends horizontally in a first direction, bends 90° and extends vertically downward, then bends 90° and extends horizontally in the first direction, then bends 180° and extends horizontally in a second direction opposite the first direction, then bends 90° and extends vertically downward, then bends 90° and extends horizontally in the second direction thereby passing through the first aperture of the first component, then bends 180° and extends horizontally in the first direction thereby passing into the second aperture of the first component wherein the steel rod of the first component is configured to create a first ledge to hold a first end of a first panel up in place at a double top plate of a wall perpendicular to the first panel; and wherein the first component is rotatable by the steel pipe handle thereof such that once the first panel is secured, the first component can be rotated 90 degrees to release the steel rod of the first component from the double top plate;

b) a second component comprising a steel pipe handle with first and second apertures and a steel rod which from a first end thereof extends horizontally in the first direction, bends 90° and extends vertically downward, then bends 90° and extends horizontally in the second direction thereby passing through the first aperture of the second component, then bends 180° and extends horizontally in the first direction thereby passing through the second aperture of the second component; wherein the first end of the steel rod of the second component is configured to slip over a second end of the first panel and the second end of the steel rod of the second component is configured to slide under a first end of a second panel thereby creating a second ledge to support the first end of the second panel; and wherein the second component is rotatable by the steel pipe handle thereof such that once the first and second panels are secured, the second component can be rotated 90 degrees to remove the steel rod of the second component from the first and second panels; and c) a third component comprising a vertical pipe section, an elongated shaft, a U-shaped bar, an outward arm, and a horizontal grasping handle; wherein the elongated shaft is disposed within the vertical pipe section, and a first end of the elongated shaft is bent 90° and terminates in a formed point; wherein the U-shaped bar is fastened to the vertical pipe section, the outward arm is fastened to the elongated shaft, and the horizontal grasping handle is fastened to a second end of the elongated shaft; wherein the U-shaped bar is configured to slip under a ceiling joist and the horizontal grasping handle is configured to be pivoted to thereby drive the formed point into the ceiling joist and position the outward arm in a direction parallel to the ceiling joist such that the outward arm provides a third ledge to support a second end of the second panel; and wherein the elongated shaft enables the third component to be operated from a floor level of a construction site.

2. The system of claim 1, wherein the panels comprise a wood stock material selected from the group consisting of plywood, oriented stranded board (OSB), and plywood.

3. The system of claim 1, wherein the panels comprise a non-wooden stock material.

4. The system of claim 1, wherein the panels comprise drywall material.

* * * * *